US007497038B2

(12) United States Patent
Arzberger

(10) Patent No.: US 7,497,038 B2
(45) Date of Patent: Mar. 3, 2009

(54) TRENCH CUTTER

(75) Inventor: Maximilian Arzberger, Igenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 244 days.

(21) Appl. No.: 11/098,654

(22) Filed: Mar. 24, 2005

(65) Prior Publication Data

US 2005/0229440 A1 Oct. 20, 2005

(30) Foreign Application Priority Data

Mar. 26, 2004 (EP) ..... 04007475

(51) Int. Cl.
*E02F 3/24* (2006.01)

(52) U.S. Cl. ..... 37/189; 37/352; 37/462; 299/106

(58) Field of Classification Search ..... 37/189, 37/462, 352, 468; 209/106; 299/106
See application file for complete search history.

(56) References Cited

U.S. PATENT DOCUMENTS

| | | | | | |
|---|---|---|---|---|---|
| 1,391,626 | A | * | 9/1921 | Gilthorpe | 175/98 |
| 2,797,065 | A | * | 6/1957 | Houston | 175/272 |
| 2,923,537 | A | * | 2/1960 | Wilcox | 299/56 |
| 2,950,902 | A | * | 8/1960 | Olds | 175/91 |
| 3,285,351 | A | * | 11/1966 | Caro | 175/89 |
| 3,710,878 | A | * | 1/1973 | Endo et al. | 175/66 |
| 3,773,121 | A | * | 11/1973 | Ikeda | 175/95 |
| 4,098,539 | A | * | 7/1978 | Zitz et al. | 299/75 |
| 4,172,616 | A | * | 10/1979 | Delli-Gatti, Jr. | 299/80.1 |
| 4,185,703 | A | * | 1/1980 | Guerber | 175/17 |
| 4,629,010 | A | * | 12/1986 | Sourice | 175/57 |
| 4,682,660 | A | * | 7/1987 | Barthelemy et al. | 175/96 |
| 4,694,915 | A | | 9/1987 | Bauer et al. | |
| 4,718,504 | A | * | 1/1988 | Terashima et al. | 175/96 |
| 4,744,425 | A | | 5/1988 | Hentschel | |
| 4,785,559 | A | * | 11/1988 | Hentschel | 37/94 |
| 4,796,713 | A | * | 1/1989 | Bechem et al. | 175/96 |
| 4,800,967 | A | * | 1/1989 | Chagnot et al. | 175/96 |
| 4,883,134 | A | * | 11/1989 | Bollinger et al. | 175/96 |
| 5,035,071 | A | * | 7/1991 | Stotzer et al. | 37/94 |
| 5,111,601 | A | * | 5/1992 | Casagrande | 37/91 |
| 5,964,305 | A | * | 10/1999 | Arzberger et al. | 175/91 |
| 6,193,444 | B1 | * | 2/2001 | Jonninen | 405/258.1 |
| 6,626,500 | B1 | * | 9/2003 | Cribb et al. | 299/78 |
| 6,865,827 | B2 | * | 3/2005 | Smith et al. | 37/386 |
| 7,114,271 | B2 | * | 10/2006 | Chagnot et al. | 37/352 |
| 7,152,346 | B2 | * | 12/2006 | Arzberger | 37/189 |
| 7,178,273 | B2 | * | 2/2007 | Arzberger | 37/189 |
| 2006/0037218 | A1 | * | 2/2006 | Stoetzer | 37/352 |

FOREIGN PATENT DOCUMENTS

| | | |
|---|---|---|
| DE | 1142815 | 1/1963 |
| DE | 1634487 A | 10/1970 |
| DE | 3424999 | 1/1986 |
| EP | 0811724 A | 12/1997 |

* cited by examiner

*Primary Examiner*—Thomas A Beach
(74) *Attorney, Agent, or Firm*—Jacobson Holman PLLC

(57) ABSTRACT

The invention relates to a trench cutter comprising at least two cutting wheels or pairs of cutting wheels, whose axes of rotation are offset from each other. A forced synchronization is achieved in accordance with the invention in that a single drive motor is provided which jointly drives the at least two cutting wheels or pairs of cutting wheels by means of a gear arrangement.

8 Claims, 1 Drawing Sheet

TRENCH CUTTER

BACKGROUND OF THE INVENTION

The invention relates to a trench cutter comprising at least two cutting wheels or pairs of cutting wheels, whose axes of rotation are offset from each other.

From DE 34 24 999 C2 two different types of trench cutters can be taken. There are trench cutters with one cutting wheel or a pair of cutting wheels having two cutting wheels that have a joint axis of rotation. As shown in FIGS. 2 and 3 of DE 34 24 999 C2, a single pair of cutting wheels is set into rotation by a joint drive. A corresponding gear arrangement to drive a single pair of cutting wheels is equally known from DE 196 52 022 A1.

A generic trench cutter having two pairs of cutting wheels that are offset from each other in a transverse direction to the axes of rotation is illustrated in FIG. 1 of DE 34 24 999 C2. The two pairs of cutting wheels are each set into rotation by a separate drive motor through a corresponding gear arrangement.

BRIEF SUMMARY OF THE INVENTION

The invention is based on the object to provide a trench cutter that ensures a reliable cutting operation whilst being of a simple and compact construction.

The object is solved according to the invention by a trench cutter having the features of claim 1. Preferred embodiments are stated in the dependent claims.

The trench cutter according to the invention is characterized in that a single drive motor is provided which jointly drives the at least two cutting wheels or pairs of cutting wheels by means of a gear arrangement.

As a result of the invention not only is the expense involved for the drive and gear of the trench cutter virtually reduced by half but in addition a joint drive and a joint gear arrangement also allow a forced synchronization of the cutting wheels. Through this it is rendered possible that the cutting wheels, which are arranged offset from each other transversely to the axis of rotation, can be located closer to each other. As a result, a particularly compact trench cutter with a good cutting performance is achieved, in the case of which the risk of getting stuck within the trench is also reduced appreciably.

A preferred embodiment of the invention resides in the fact that the gear arrangement has a sun wheel that is substantially arranged at a central position between the two mutually offset axes of rotation. This results in a symmetrical introduction of the torque, whereby a particularly uniform torque distribution is rendered possible.

A particularly compact gear arrangement is achieved according to the invention in that the two cutting wheels or pairs of cutting wheels each have a drive train which is driven by the sun wheel.

A particularly good torque distribution in a compact construction is achieved in accordance with the invention in that the drive trains are arranged at an acute angle to the axis of the sun wheel. Together with the sun wheel the drive trains form an arrangement in the shape of a Y turned upside down, in which the drive trains are arranged above the axes of rotation of the cutting wheels and are directed upwards. Preferably, the acute angle ranges between 15° and 60°, in particular 45°.

To achieve a good load distribution is it particularly preferred that the drive trains are arranged approximately at a right angle with respect to each other.

According to a further embodiment of the invention it is intended that the drive trains each have at least one transmission gear. Obviously, a reduction gear is also understood by the term transmission gear. In this manner a desired torque conversion can take place directly at the cutting wheels. In addition, in the case of the arrangement of pairs of cutting wheels the drive trains also have a distribution gear each, through which the torque of the drive train is distributed in equal amounts to the cutting wheels disposed along the same axis of rotation.

Furthermore, it is of advantage according to the invention that radially protruding cutting teeth are provided on the cutting wheels or pairs of cutting wheels, which are arranged in a meshing manner during operation. On account of the forced synchronization of the adjacent positioned cutting wheels that can be achieved by the invention, the cutting wheels can be arranged at such a close distance to each other that they mesh without any risk. Thus, an evenly high cutting performance can be achieved across the entire cutting cross section.

A particularly good embodiment of the invention that requires little maintenance is provided in that the drive motor and the gear arrangement are arranged in a cutter housing.

In this connection it is particularly preferred that the trench cutter is mounted on a telescopic rod and that in the direction of the axes of rotation the thickness of the cutter housing is smaller than or equal to the maximum diameter of the telescopic rod. Whereas conventional cutters usually have a very large cutting frame that is required for the guiding of the trench cutter in the trench, the compact trench cutter according to the invention can be guided by a telescopic rod. Owing to the compact construction of the cutter housing in accordance with the invention that does not project beyond the maximum diameter of the telescopic rod in the direction of the axes of rotation, the risk that the trench cutter gets stuck in the trench is reduced drastically.

In another preferred embodiment it is intended according to the invention that a main drive shaft is arranged between the drive motor and the sun wheel. At both of its ends the main drive shaft can each have spiral toothings which are arranged in a meshing fashion in corresponding toothing sleeves of the drive motor or the sun wheel. An arrangement of such kind allows a compensation of impacts and twists occurring between the drive motor and the sun wheel so that a gear arrangement with a particularly long lifespan is provided.

In the following the invention will be described in greater detail with reference to an embodiment depicted in a strongly schematized manner in the single drawing.

DETAILED DESCRIPTION OF THE INVENTION

Figure 1:
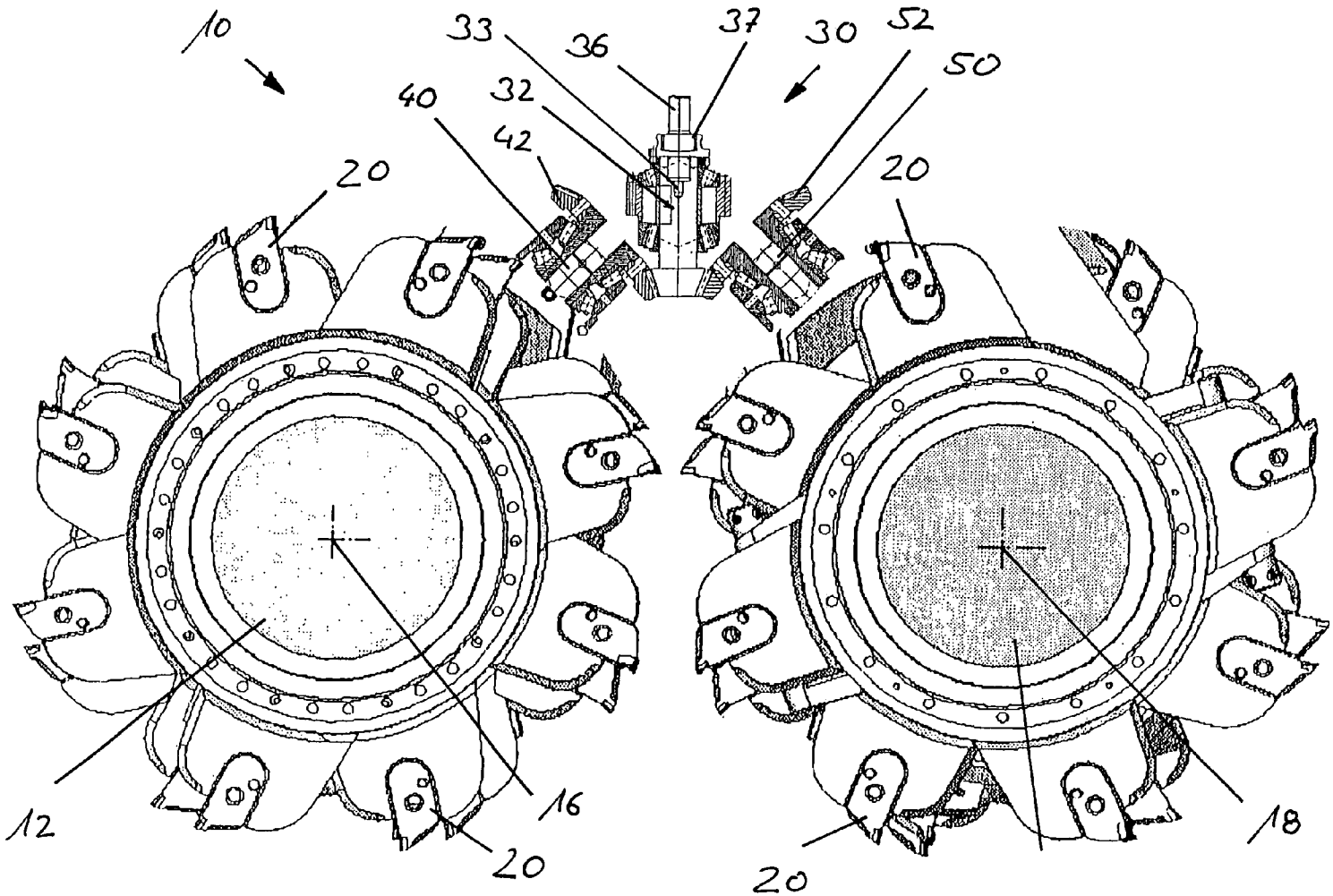
FIG. 1 is a schematic drawing of the present invention.

A trench cutter 10 according to the FIGURE shows two cutting wheels 12, 14, at whose outer circumference a plurality of cutting teeth 20 is arranged. The cutting wheels 12, 14 each belong to a pair of cutting wheels, of which the rear cutting wheel is not illustrated. The cutting wheel 12 on the left side belonging to the one pair of cutting wheels rotates about a first axis of rotation 16, while the cutting wheel 14 on the right side belonging to the other pair of cutting wheels rotates about a second axis of rotation 18. The two axes of rotation 16, 18 are offset from each other in a transverse direction by a predetermined distance. The cutting wheel 12 on the left side is driven in the clockwise direction, whereas the cutting wheel 14 on the right side is driven in the counterclockwise direction.

From a joint drive motor, not depicted here, that is arranged above the axes of rotation 16, 18 the driving torque is transmitted via a gear arrangement 30 to the cutting wheels 12, 14 or their pairs of cutting wheels. The torque is transmitted to the drive motor via a main drive shaft 36, partly depicted here, to a sun wheel 32. To this end the main drive shaft 36 has a spiral toothing 37 at its lower end which is arranged in a corresponding toothing sleeve at the upper end of the sun wheel 32. The sun wheel 32 has an axis 33 which is directed approximately perpendicularly to the axes of rotation 16, 18 of the cutting wheels 12, 14 and is arranged in a central position thereto.

From a pinion gear of the sun wheel 32 the torque is transmitted in a meshing connection via ring gears 42, 52 to the drive trains 40, 50 for the cutting wheels 12, 14 or their pairs of cutting wheels. The drive trains 40, 50 each have transmission gears, not depicted here, which reduce the rotational speed of the sun wheel 32 and thereby increase the torque for the cutting wheels 12, 14 to a desired value. By reducing the torque at the sun wheel 32 through the ring gears 42, 52 at opposite positions a uniform torque distribution can be achieved in a simple manner in the opposite direction of rotation, with the drive trains 40, 50 being otherwise unchanged in their construction.

The axes of the drive trains 40, 50 are arranged approximately at a right angle to each other and together with the axis 33 of the sun wheel 32 they form a Y-arrangement turned upside down.

The invention claimed is:

1. Trench cutter comprising:

at least first and second drive trains, at least first and second pairs of coaxial cutting wheels, the first pair of coaxial cutting wheels being rotatable about a first axis of rotation in a first rotational direction, and the second pair of coaxial cutting wheels being rotatable about a second axis of rotation in a second rotational direction opposite the first rotational direction, the first and second axes of rotation being transversely offset from each other, and the first and second pairs of cutting wheels being driven in the first and second rotational directions, respectively, by the first and second drive trains, a gear arrangement including a sun wheel, the sun wheel being arranged in a substantially central position between the two transversely offset axes of rotation, the sun wheel driving the first and second drive trains, and a single drive motor driving the at least first and second pairs of cutting wheels jointly by means of the gear arrangement.

2. Trench cutter according to claim 1, further comprising radially protruding cutting teeth provided on the pairs of cutting wheels, the cutting teeth being arranged in a meshing manner during operation.

3. Trench cutter according to claim 1, further comprising a cutter housing, wherein the drive motor and the gear arrangement are arranged in the cutter housing.

4. Trench cutter according to claim 3, wherein the trench cutter is mounted on a telescopic rod and in the direction of the axes of rotation the thickness of the cutter housing is smaller than or equal to the maximum diameter of the telescopic rod.

5. Trench cutter according to claim 1, further comprising a main drive shaft arranged between the drive motor and the sun wheel.

6. Trench cutter according to claim 1, wherein the drive trains are arranged at an acute angle to the axis of the sun wheel.

7. Trench cutter according to claim 1, wherein the drive trains are arranged approximately at a right angle with respect to each other.

8. Trench cutter according to claim 1, wherein the drive trains each have at least one transmission gear.

* * * * *